US011753825B2

(12) United States Patent
Baker

(10) Patent No.: US 11,753,825 B2
(45) Date of Patent: Sep. 12, 2023

(54) METHOD AND APPARATUS FOR METAL VALLEY INSTALLATION

(71) Applicant: David Ray Baker, Williamston, MI (US)

(72) Inventor: David Ray Baker, Williamston, MI (US)

( * ) Notice: Subject to any disclaimer, the term of this patent is extended or adjusted under 35 U.S.C. 154(b) by 34 days.

(21) Appl. No.: 17/587,429

(22) Filed: Jan. 28, 2022

(65) Prior Publication Data

US 2022/0243473 A1 Aug. 4, 2022

Related U.S. Application Data

(60) Provisional application No. 63/144,180, filed on Feb. 1, 2021.

(51) Int. Cl.

| | |
|---|---|
| ***E04D 1/06*** | (2006.01) |
| ***E04D 1/34*** | (2006.01) |
| ***E04D 5/10*** | (2006.01) |
| ***E04D 11/02*** | (2006.01) |
| ***E04D 5/14*** | (2006.01) |

(52) U.S. Cl.

CPC ..... *E04D 1/06* (2013.01); *E04D 1/34* (2013.01); *E04D 5/10* (2013.01); *E04D 5/145* (2013.01); *E04D 11/02* (2013.01)

(58) Field of Classification Search

CPC .... E04D 1/06; E04D 1/34; E04D 5/10; E04D 5/145; E04D 11/02; E04D 13/0445; E04D 13/0477; E04D 2013/0454

See application file for complete search history.

(56) References Cited

U.S. PATENT DOCUMENTS 1,685,524 A * 9/1928 Dow ..... E04D 13/0445 52/13
1,813,084 A * 7/1931 Robinson ..... E04D 13/0445 156/216
1,813,089 A * 7/1931 Shakespeare ..... E04D 13/064 52/13
1,871,068 A * 8/1932 Macan ..... E04D 3/40 428/468
2,160,642 A * 5/1939 Bumpas ..... E04D 13/0445 52/95
2,226,239 A * 12/1940 Elmendorf ..... E04D 3/351 52/409
2,258,078 A * 10/1941 Tennison ..... E04D 13/064 52/13

(Continued)

FOREIGN PATENT DOCUMENTS

GB 2307922 A * 6/1997 ..... E04D 13/0445

*Primary Examiner* — James M Ference

(74) *Attorney, Agent, or Firm* — KNECHTEL, DEMEUR & SAMLAN

(57) ABSTRACT

A unique method and apparatus for metal valley installation that waterproofs shingled roof applications in valley (e.g., such as "V" or "W" metal valley angled roof) applications. Applicant's invention provides a membrane situated between the metal valley and the shingles with a portion of the membrane being situated and secured to the roof deck between the ice and water shield and the shingles. The membrane creates a dead zone that collects or prevents ice and water from backing up from the roof valley over the metal valley, over the edge of the metal valley, and in between the ice and water shield and the shingles.

7 Claims, 3 Drawing Sheets

(56) References Cited

U.S. PATENT DOCUMENTS 3,225,726 A * 12/1965 Tennison, Jr. ..... B21D 5/08 29/417
3,264,790 A * 8/1966 Beals ..... E04D 3/40 52/287.1
4,411,120 A * 10/1983 Ellis ..... E04D 13/0445 52/287.1
4,449,333 A * 5/1984 Stratton ..... E04D 13/0445 52/514
4,489,532 A * 12/1984 Ellis ..... E04D 1/30 52/13
5,065,553 A * 11/1991 Magid ..... E04D 13/1407 52/60
5,115,603 A * 5/1992 Blair ..... E04D 13/0445 52/60
6,578,325 B2 * 6/2003 Henderson ..... E04D 13/17 52/198
6,912,813 B2 * 7/2005 Grizenko ..... E04D 13/1478 52/95
8,650,804 B2 * 2/2014 Skoretz ..... E04D 13/0445 52/60
10,024,060 B2 * 7/2018 Givens ..... E04D 1/36
2002/0066243 A1 * 6/2002 Henderson ..... E04D 1/36 52/302.3
2003/0121217 A1 * 7/2003 Grizenko ..... E04D 13/158 52/287.1
2005/0126103 A1 * 6/2005 Scheirer ..... E04D 5/12 52/518
2011/0277391 A1 * 11/2011 Skoretz ..... E04D 13/0445 52/13
2017/0370104 A1 * 12/2017 Givens ..... E04D 1/36
2019/0309519 A1 * 10/2019 Folkersen ..... E04D 1/28
2022/0243473 A1 * 8/2022 Baker ..... E04D 5/10

* cited by examiner

METHOD AND APPARATUS FOR METAL VALLEY INSTALLATION

I. CROSS-REFERENCE TO RELATED APPLICATION

This patent application is a non-provisional application claiming priority from U.S. Provisional Patent Application Ser. No. 63/144,180, entitled "Method and Apparatus for Metal Valley Installation", filed on Feb. 1, 2021, and is fully incorporated herein by reference.

II. FIELD OF THE INVENTION

The present invention relates to waterproofing the roof of a dwelling or other structure such as a roof having an open metal valley. More particularly, Applicant's invention is a method for securing and waterproofing valley shingles in shingled roof applications, while allowing freedom of movement between the metal valley and the valley shingles, and, allowing the easy removal of worn shingles without damaging existing valley metal.

III. DESCRIPTION OF THE PRIOR ART

Current common method: The current method of installing a metal valley involves first, applying a layer of "ice and water shield", which is a commonly used, roll-dispensed membrane, with or without a granulated surface, and a bitumen or similarly functioning tacky layer (which seals around roofing nails) for adhesion to a wood roof deck. A metal valley strip, in a "V" or "W" configuration, with an included angle the same as that of the intersecting roofs, is then laid on the newly applied ice and water shield and secured to the roof deck, through the ice and water shield, with edge clips, or nail heads only. The valley shingles are cut to length and with the corresponding angle of the valley. It is commonly thought that driving water may possibly funnel along the top edge of each shingle, lodging between shingles, or working back past the metal valley strip to the roof deck. To prevent this, the top corner of each shingle, where it meets the valley, is sometimes chamfered so that driving water can be glanced off and directed down the valley. The valley shingles are then laid and the shingles are adhered to the metal valley strip with caulking or roofing cement, typically petroleum base. However, this likewise continues to experience problems.

Accordingly, Applicant has invented a unique method and apparatus to solve this problem. Thus, there is a need and there has never been disclosed Applicant's inventive method and apparatus for metal valley installation.

IV. SUMMARY OF THE INVENTION

The present invention is a unique method and apparatus for metal valley installation that waterproofs shingled roof applications in valley (e.g., such as "V" or "W" metal valley angled roof) applications. Applicant's invention provides a membrane situated between the metal valley and the shingles with a portion of the membrane being situated and secured to the roof deck between the ice and water shield and the shingles. The membrane creates a dead zone that collects or prevents ice and water from backing up from the roof valley over the metal valley, over the edge of the metal valley, and in between the ice and water shield and the shingles.

IV. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
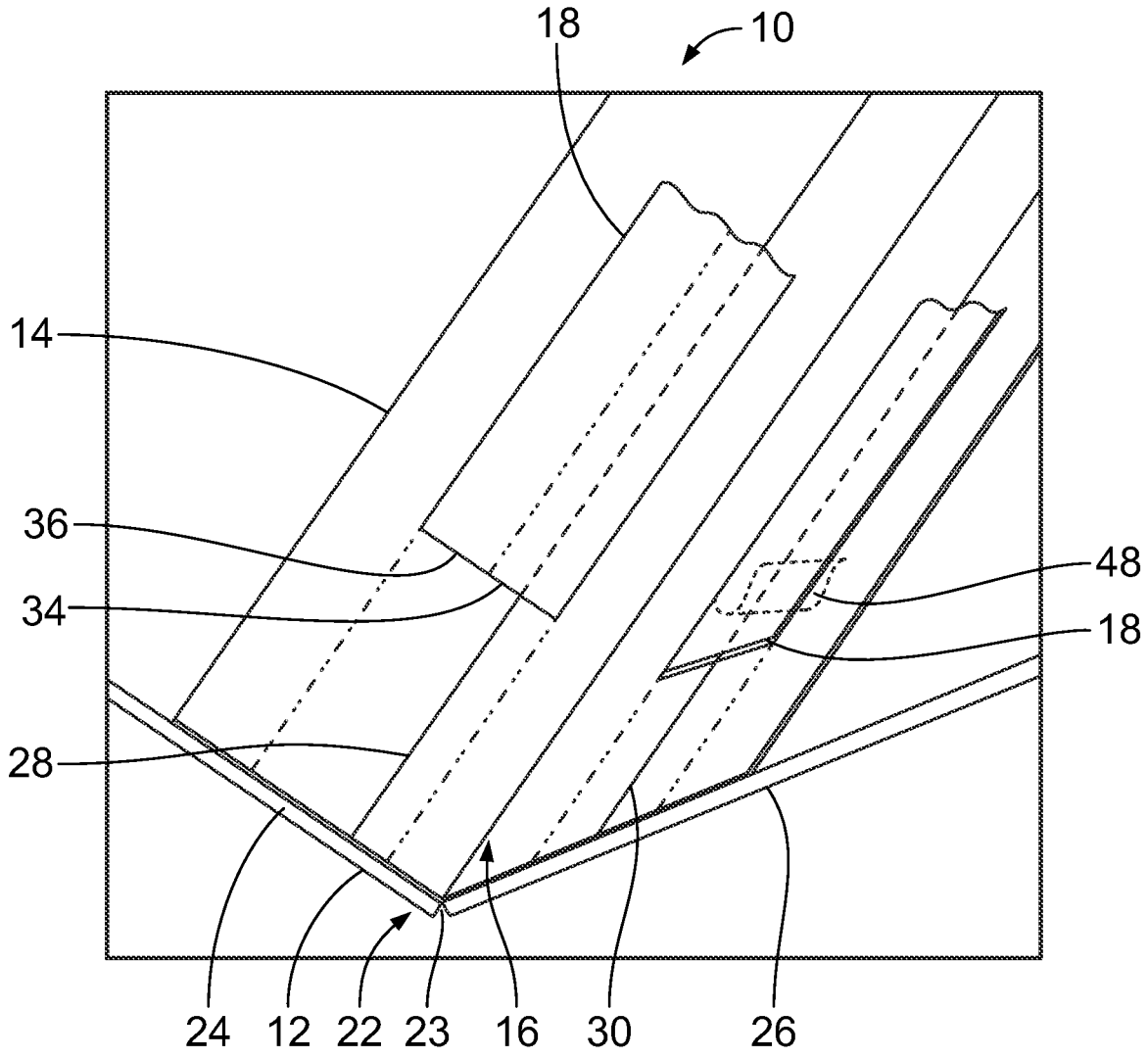
FIG. 1 is a top perspective view of the roof valley of a roof deck covered with an ice and water shield and further illustrating the membrane to be applied.
Figure 2:
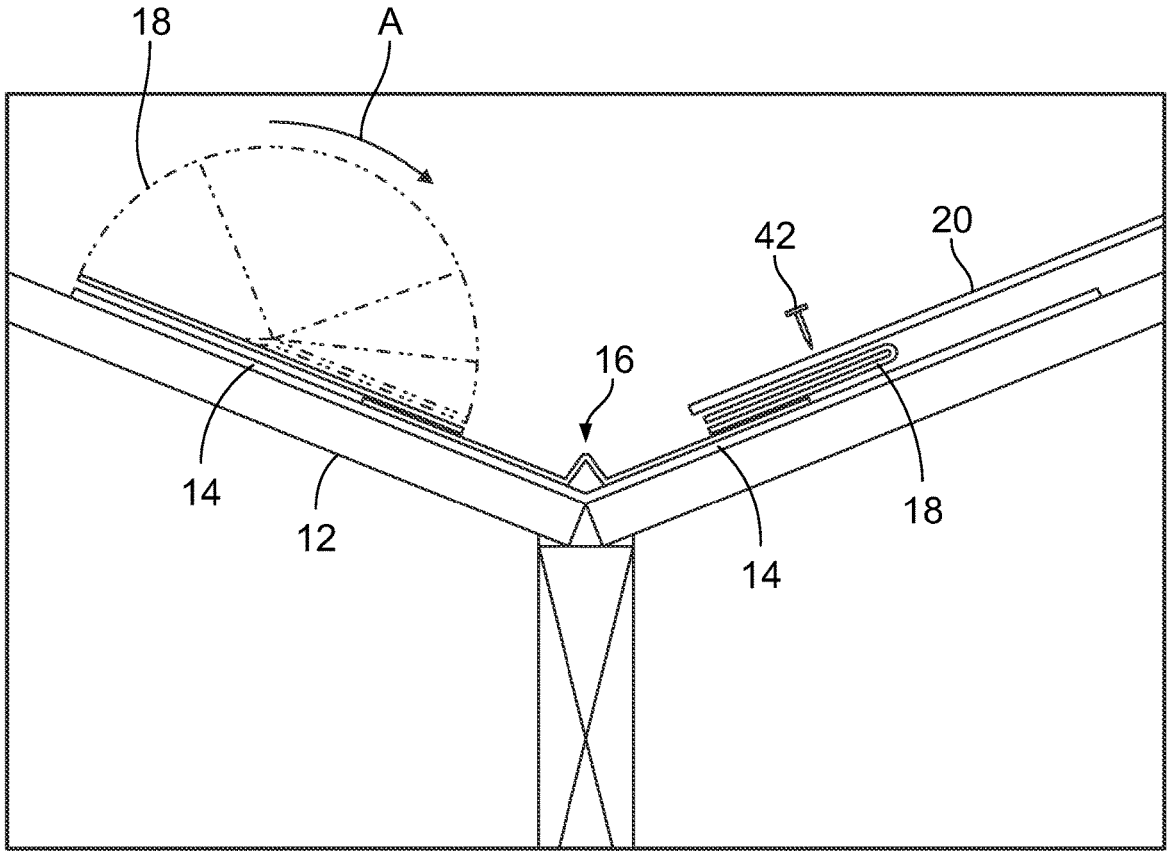
FIG. 2 is a side perspective view of the roof valley of a roof deck covered with an ice and water shield and further illustrating the installation, folding, and securing of the membrane, along with the covered shingles.
Figure 3:
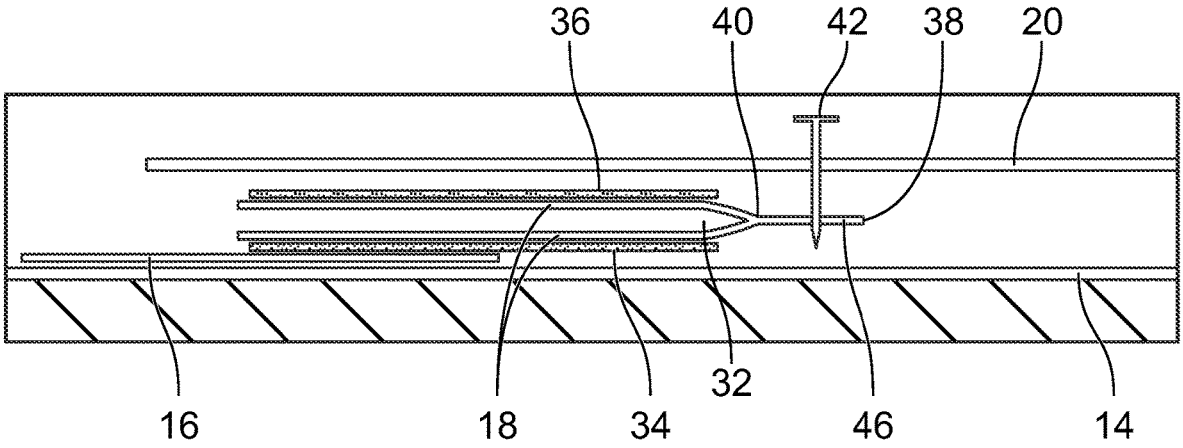
FIG. 3 is a side perspective view of the roof valley of a roof deck covered with an ice and water shield and further illustrating the installation, folding, and alternate securing of the membrane, along with the covered shingles.

Referring to FIGS. 1 through 3, Applicant's invention for a roof valley of a roof deck 10 is illustrated. The invention for the roof valley of a roof deck 10 comprises a roof deck 12, an ice and water shield 14, a metal valley 16, a membrane 18, and shingles 20.

The roof deck 12, preferably made of a plywood or OSB type material, is illustrated in a "V" shape to create a roof valley 22 having a centerline 23 (also referred to as a base), and that extends up to an apex or the top of the roof valley 22. The roof valley 22 can be provided with any slope, although the slope is typically more evident in the bent metal (copper) valley 16 applications. Alternatively, Applicant's invention likewise applies in any other angled roof valley application(s) and/or angled slope(s).

The ice and water shield 14 is a water protector, sometimes also referred to as "peel and stick", is a waterproof roof underlayment layer or shield developed to protect vulnerable areas on the roof deck 12 from ice and water damage. One such ice and water shield 14 is sold under the Grace Ice & Water Shield® brand. Typically, the ice and water shield 14, for example, is made with polymer-modified bitumen. In Applicant's invention, the ice and water shield 14, and as described in more detail herein, is situated and covers the roof valley 22 and is usually confined to, and runs in, the same direction as the roof valley 22.

The metal valley 16 is an exposed metal pan, preferably made of a copper material or any other material known to one skilled in the art, that is positioned at the intersection of the adjoining roof slopes 24 and 26 of the roof valley 22. The metal valley 16 has defined edges 28 and 30 and also extends over the edge of the eave of the roof deck 12 with the edges secured by any fastening means known to one skilled in the art such as copper nails. This has long been a common way of coping with the increased volume of water that naturally occurs at these intersections.

The membrane 18, and as described in more detail herein, is positioned over portions of both the ice and water shield 14 and metal valley 16 and is preferably secured using the adhesion (discussed in more detail below). Additionally, when securing or fastening the shingles 20 in place, a fastening means such as nails is placed as close as possible to the metal between the shingles 20, the ice and water shield 14, and the roof deck 12.

The membrane 18 is designed and manufactured for the use of securing and waterproofing the transition of the open metal valley 16 strip to a roof deck 12 and the means of bonding valley shingles 20 to the same membrane 18. Some of the characteristics of the membrane 18 can be similar to commonly used ice and water shields 14 currently in use in roofing applications with the following additional features.

The membrane 18 can be of a film surface, or mineral surface, with an adhesive petroleum-based, or similarly functioning backing, which, when pressed against a roof deck 12, ice and water shield 14, and metal valley 16 strip, secures and waterproofs the transition. The membrane 18 can feature one continuous adhesive backing, or alternatively feature (2) adhesive backing zones of differing characteristics, with one adhesive zone 34 formulated for adhering the membrane 18 to either: (i) the roof deck 12, (ii) the ice and water shield 14, or (iii) the combination of the ice and water shield 14 and the metal valley 16, as illustrated in FIGS. 2 and 3, and one adhesive zone 36 formulated for adhering the membrane 18 to the underside of the shingles 20.

The membrane 18 can be produced to be dispensed from a roll, or in lengths, with the adhesive backing(s) or zones 34 and 36 covered with (2) zones of protective paper or film layers 48 to facilitate the exposure of each adhesive zone 34 and 36 individually. The adhesive zones 34 and 36 converge at the centerline 38 of the membrane 18 along its length which also coincides with a fold line 40, which is manufactured into the membrane 18 to allow for a naturally occurring fold during installation. The membrane 18 can also be produced to be dispensed from a roll already in the folded condition. The metal valley 16 can also be produced with the membrane 18 pre-attached along its edges and delivered to the site in a ready to apply form.

Inventive method: Applicant's inventive method begins after the metal valley 16 strip is set in place. At this step, the membrane 18 is used to secure the metal valley 16 strip against the ice and water shield 14 that was previously laid on the roof deck 12. In the preferred embodiment, the membrane 18 simultaneously covers both a portion of the metal valley 16 and the ice and water shield 14 and is situated between the metal valley 16 and ice and water shield 14 and the shingles 20 that cover the metal valley 16 and ice and water shield 14.

After installation and during use, this membrane 18 is formed into a double layer (e.g., with each layer of the double layer preferably of equal lengths) and provides a dead end or dead zone 32, as illustrated in FIG. 3, that collects or prevents ice and water from backing up from the roof valley 22 over the metal valley 16, over the edge of the metal valley 16, and in between the ice and water shield 14 and shingles 20 (i.e., in the absence of the membrane 18).

The membrane 18 can be supplied in a roll form and will feature a bitumen or similarly functioning coating. This coating can be continuous across the membrane 18, or, can be zones of differing characteristics, with zones meeting at the center of the membrane 18 and running its longitudinal length. Meeting at the center of its length will be (2) protective paper 48 peel-and-stick zones, allowing (1) zone to be stripped individually along the membrane 18 center. Corresponding with this center is a fold line 40 that will allow the membrane 18 to be easily folded in half along its center, as illustrated in FIG. 2 (e.g., left side, where the membrane 18 is folded in the direction of Arrow A). After it has been cut from the roll, the membrane 18 is laid flat, or folded, and positioned so that one half of the membrane 18 (one of the paper covered zones) covers equally, the metal valley 16 strip and the previously laid ice and water shield 14, as further illustrated in FIGS. 2 and 3. After being positioned, the peel-and-stick paper 48 is removed from this zone and the membrane 18 is pressed against the metal valley 16 strip and the previously laid ice and water shield 14. This process of removing a piece of membrane 18 from the roll, positioning, peeling, and pressing it, is repeated for the opposite side of the metal valley 16 strip. In this manner, the membrane 18 in the folded state is placed equidistant over and from the edges 28 and 30 of the metal valley 16. At this point in the process the metal valley 16 is secured into place and the transition between the metal valley 16 and the roof deck 12 has been waterproofed. This process can also be applied if the installer has used metal valley 16 strip retaining clips.

Alternatively, in an alternate embodiment, another approach to the process can be to leave the paper 48 on the top half of the membrane 18 fold until all the valley shingles 20 are in place and then peel the paper 48 out from under the shingles 20 as the last step. This would be the fastest way to do it. The only drawback with this method is the shingles 20 cannot be nailed as close to the valley. You would have to keep the nails away from the still-papered membrane 18, as it would be difficult to remove the paper with nails through it. But if this process is ever implemented, removing the paper last will probably be the most common way to do it. Applicant prefers getting the nails as close to the metal as possible, as can then keep the metal as tight to the roof as possible.

Prior to laying the valley shingles 20, if the membrane 18 has not been folded prior to securing it to the roof deck, it is folded along its centerline 38 at this point, back onto itself, into a doubled-up condition. This folding process then exposes the adhesive zone or side 36 of the membrane 18 in the up position, and is ready, after peeling the protective paper 48 layer, to receive valley shingles 20. After a valley shingle 20 has been cut to length, at the appropriate angle to meet the metal valley 16, the paper 48 is removed, exposing the adhesive, and the valley shingle is pressed against the roof deck 12 to secure it into place. This is repeated for each course of shingles 20. In this manner, as illustrated in FIGS. 2 and 3, the shingles 20 cover the entire membrane 18.

One of the characteristics of a metal valley 16 is the large change in length due to temperature variation. For this reason, nailing directly into metal valley 16 is typically avoided to prevent the contraction and expansion of the metal eventually fatiguing the material and causing stress fractures and subsequent leaking. Thus, in Applicant's invention, and as illustrated in FIGS. 2 and 3, a fastening or securing means 42 is used to fasten or secure the membrane 18 to the roof deck 12 between the ice and water shield 14 and the shingles 20. Preferably, the fastening or securing means 42 is a nail or any other fastening or securing means known to one skilled in the art. Additionally, it is contemplated that the fastening or securing means 42 is, as illustrated in FIG. 2, inserted through the shingle 20, through the membrane 18 and into the ice and water shield 14 and roof deck 12; or alternatively, the fastening or securing means 42 is, as illustrated in FIG. 3, inserted through an extension 46 extending outwardly from the fold line 40 of the membrane 18 and into the ice and water shield 14 and roof deck 12.

The same movement of metal valley 16 can also adversely affect the adhesive bond between the metal valley 16 and the shingles 20 when using the current typical method of caulking or cementing the shingles 20 directly to the metal valley 16 strip. Using the folding membrane 18 of Applicant's invention isolates the shingles 20 from the movement of the metal valley 16 strip, as it expands and contracts separately from the shingles 20.

This isolation is also beneficial under conditions of ice buildup as the membrane 18 and bonded shingles 20 are able to move together but independently from the metal valley 16, where the current typical method of direct adhesion is susceptible to the expansion of ice.

Figure 4:
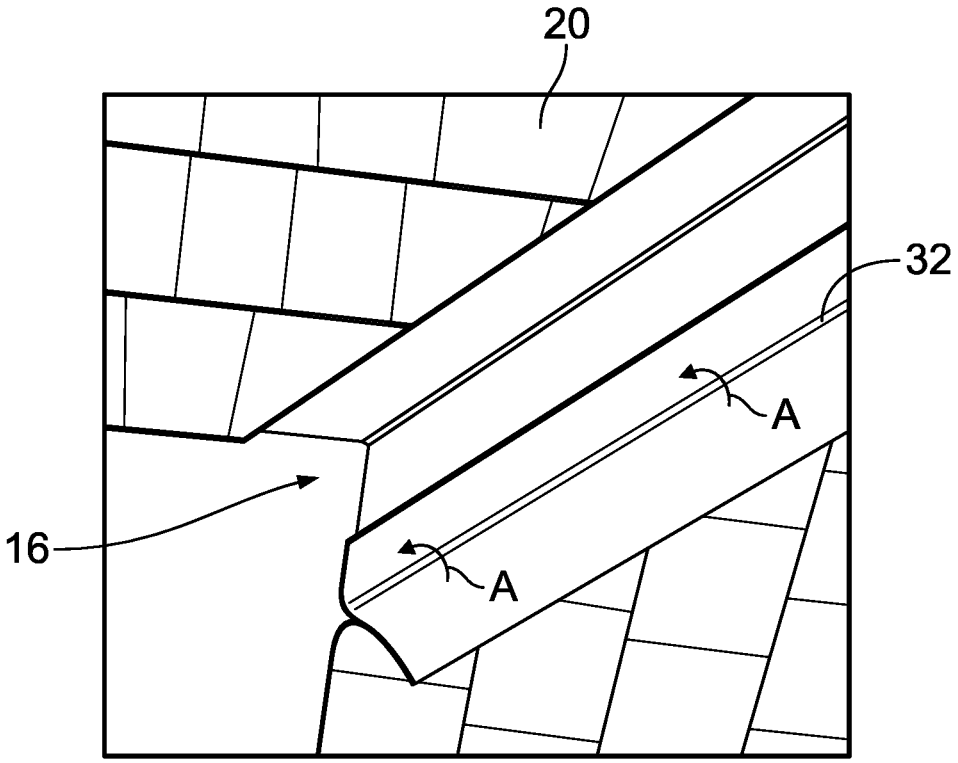
FIG. 4 is a top perspective view of the folding of the membrane during installation on a roof deck.
Figure 5:
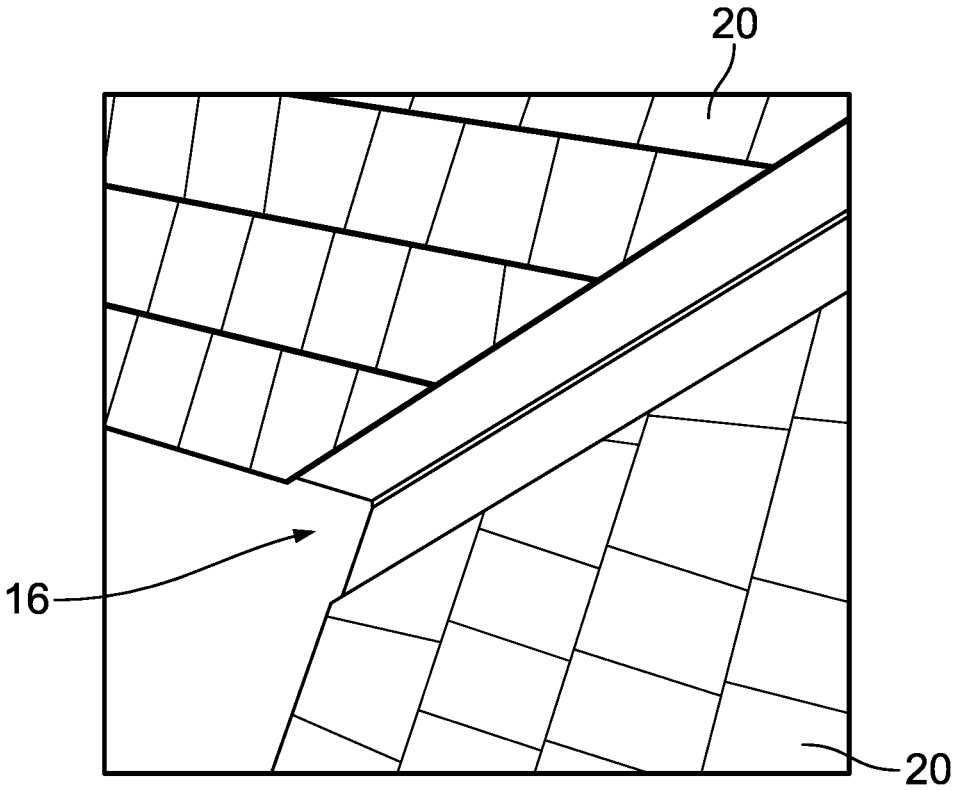
FIG. 5 is a top perspective view of the finished roof valley of a roof deck after the process and installation of the ice and water shield, membrane, and shingles has been completed for both sides of the roof valley.

Another advantage of the folding membrane 18 is the increased area of adhesion between the shingles 20 and the membrane 18 which may negate the need to chamfer the tops of the shingles 20 at the valley. This method minimizes the entry points of water as each shingle 20 is pressed against the adhesive backing. If water should at any time drive up under the valley shingles 20, its ability to drive between shingles 20 is minimized and any water that drives up behind the membrane 18 is stopped by the dead end or dead zone 32, as illustrated in FIG. 4, created when the membrane 18 was folded back on itself. This can offer an additional advantage when considering the width of metal valley 16, as it is often as wide as 20" or more to prevent water intrusion in the event of ice dam buildup. If for example a metal valley 16 width of 14" is used, and each edge of the metal is covered with the folding membrane 18 which overlaps each metal edge and extends an additional 3", then the total effective coverage of protection would still be 20". The material cost savings can be substantial when using metal valley 16 made from copper.

Another advantage is how the shingle 20 travels with the membrane 18. Though the shingle 20 is adhered to the roof deck 12 through the membrane 18, the shingle 20 is still isolated from the heat induced movements of the copper metal valley 16. Also, if ice ever accumulated in this area, it would pose no damage, as Applicant's invention allows the structure to flex, thereby protecting the valley shingle structure from the expansive nature of frozen water. In the currently typical process of adhering the shingles to the copper via roofing cement or caulk, the underside of the shingle 20 would have been adhered into place against the copper metal valley 16 directly, which makes this adhesion area vulnerable to the expansive quality of freezing water and to the lateral movement of the heat induced copper expansion.

An additional benefit of this method would become apparent during re-roofing where this method had been previously applied. With the current conventional method of applying shingles 20 to open metal valleys, re-roofing would require the separation of previously cemented shingles 20 from the metal valley 16 by prying and cleaning the metal surface, or, replacing the valley metal 16 entirely. With Applicant's unique method proposed here, the shingle 20/membrane 18 assembly would be pried back to expose the fold of the membrane 18 adequately to cut through the membrane 18, leaving the original layer of membrane 18 which adheres the metal to the roof deck 12 (which had been previously covered with ice and water shield 14) intact. Because the membrane 18 has the same semi-permanent nature of ice and water shield 14, any section of membrane 18 that could not be easily removed from the roof deck 12 or metal valley 16, can be left in place, and a new membrane 18 can be placed directly over.

Therefore, the application of this method would result in minimal damage to existing metal valley 16, which is especially advantageous when working with costly metal valley 16 such as copper.

Thus, there has been provided Applicant's unique invention. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A method for waterproofing a roof deck, comprising the steps of:

providing the roof deck having an angled slope and defining a base and an apex;

installing a shield layer over a portion of the angled slope from the base up toward the apex;

installing a metal valley over a portion of the shield layer from the base up toward the apex;

the portion of the shield layer covered by the installed metal valley being defined as a covered shield layer with a remaining portion of the shield layer being defined as an uncovered shield layer;

providing a membrane formed in one continuous length and defining a first half and a second half;

installing a first portion of the first half of the membrane over the covered shield layer and a second portion of the first half of the membrane over the uncovered shield layer on the angled slope;

folding the second half of the membrane on top of the first half of the membrane and defining a spacing between them as a dead zone;

installing a shingle layer over the first membrane; and whereby, the dead zone prevents ice and water from backing up from the base toward the apex, over the metal valley, and in between the shield layer and the shingle layer of the angled slope.

2. A method for waterproofing a roof deck, comprising the steps of:

providing the roof deck having opposing angled slopes creating a valley between them having a centerline;

installing a shield layer over the centerline of the valley and a portion of each of the opposing angled slopes;

installing a metal valley over the centerline and a portion of the shield layer installed over each of the opposing angled slopes; the portion of the shield layer covered by the installed metal valley being defined as a covered shield layer with a remaining portion of the shield layer being defined as an uncovered shield layer;

performing the following steps for installing a first membrane:

(a) placing a first portion of the first membrane over a portion of the metal valley on one of the opposing angled slopes;

(b) placing a second portion of the first membrane over a portion of the uncovered shield layer on one of the opposing angled slopes;

(C) folding a third portion of the first membrane over both the first portion and second portion of the first membrane for creating a first dead zone;

performing the following steps for installing a second membrane:

(d) placing a first portion of the second membrane over a portion of the metal valley on the other of the opposing angled slopes;

(e) placing a second portion of the second membrane over a portion of the uncovered shield layer on the other of the opposing angled slopes;

(f) folding a third portion of the second membrane over both the first portion and second portion of the second membrane for creating a second dead zone;

installing a shingle layer over each of the first membrane and the second membrane; and whereby, each of the first dead zone and the second dead zone prevents ice and water from backing up from the valley, over the metal valley, and in between the shield layer and the shingle layer of the opposing angled slopes.

3. The method of claim 2 and further comprising the step of providing a length of the first portion of the first membrane to be substantially the same as a length of the second portion of the first membrane.

4. The method of claim 2 and further comprising the step of providing a length of the third portion of the first membrane to be substantially the same as a combined length of the first and second portion of the first membrane.

5. The method of claim 2 and further comprising the step of inserting a fastener through the shingle layer, the third portion of the first membrane, the second portion of the first membrane, and the shield layer for collectively securing them to the roof deck.

6. The method of claim 2 and further comprising the step of providing a first extension to the first membrane.

7. The method of claim 6 and further comprising the step of inserting a fastener through the shingle layer, the first extension of the first membrane, and the shield layer for collectively securing them to the roof deck.

* * * * *